United States Patent [19]

Faupel et al.

[11] Patent Number: 4,905,640

[45] Date of Patent: Mar. 6, 1990

[54] FUEL INJECTION PUMP

[75] Inventors: Werner Faupel, Gerlingen; Klaus Schmidt, Vaihingen/Enz, both of Fed. Rep. of Germany

[73] Assignee: Robert Bosch GmbH, Stuttgart, Fed. Rep. of Germany

[21] Appl. No.: 317,503

[22] Filed: Mar. 1, 1989

[30] Foreign Application Priority Data

Apr. 25, 1988 [DE] Fed. Rep. of Germany ..... 3813880

[51] Int. Cl.[4] ..... F02M 39/00

[52] U.S. Cl. ..... 123/179 L; 123/502

[58] Field of Search ..... 123/502, 179 L, 449, 123/450

[56] References Cited

U.S. PATENT DOCUMENTS

| | | | |
|---|---|---|---|
| 4,395,990 | 8/1983 | Hofer | 123/179 L |
| 4,430,974 | 2/1984 | Bofinger | 123/502 |
| 4,453,522 | 6/1984 | Salzgeber | 123/179 L |
| 4,489,698 | 12/1984 | Hofer | 123/502 |
| 4,509,491 | 4/1985 | Kawatei | 123/502 |
| 4,619,238 | 10/1986 | Hain | 123/502 |
| 4,622,943 | 11/1986 | Braun | 123/502 |
| 4,733,645 | 3/1988 | Hain | 123/502 |
| 4,796,592 | 1/1989 | Hofer | 123/179 L |

*Primary Examiner*—Carl S. Miller

*Attorney, Agent, or Firm*—Edwin E. Greigg

[57] ABSTRACT

A pressure control valve is connected at one end with a suction chamber and with increasing pressure in the suction chamber shifts the instant of injection to early. A pressure relief line connects between a restoring chamber in the pressure control chamber with a pressure maintenance valve. The pressure maintenance valve includes a valve insert comprising a valve cylinder in which a compression spring-loaded valve body is disposed. The valve body has a sealing face that closes the pressure relief line. The diameter of the pressure relief line is smaller than the valve cylinder diameter. The diameter of the pressure relief line is selected such that the suction chamber pressure present at the sealing face moves the valve body away from the valve seat counter to the force of a compression spring contacting the valve body and opens up a pressure relief line leading onward. After the lifting of the valve body from the pressure relief line, the suction chamber pressure is present at the entire cross section of the valve body, and the force, now embodied by the cross section of the valve body and the suction chamber pressure established at idling rpm, attains a value, by comparison with the force of the compression spring that keeps the valve body away from the pressure relief line. This assures that the function of the cold start acceleration takes place only upon the first run-up of the engine. A rapid cold start acceleration is thereby advantageously attained, and a loud engine noise is only briefly audible.

21 Claims, 2 Drawing Sheets

FUEL INJECTION PUMP

BACKGROUND OF THE INVENTION

The invention is based on a fuel injection pump as defined herein. In a fuel injection pump of this type known from German Offenlegungsschrift No. 26 48 043, an injection adjusting piston of the injection onset adjuster is controlled as a function of suction chamber pressure. The suction chamber pressure is determined via the pressure control valve, which sets a pressure that increases with rising rpm. As long as the pressure maintenance valve in the pressure relief line is closed, a higher pressure is attained in the suction chamber, and this adjusts the injection onset to "early". Upon attainment of a predetermined high rpm, at which the suction chamber pressure overcomes the opening pressure of the pressure maintenance valve, the suction chamber pressure is limited to this opening pressure. Upon attainment of the engine operating temperature, the control device also, by means of a displaceable mandrel, lifts the valve body of the pressure maintenance valve from its seat and thus keeps the pressure maintenance valve in the open position. From this operating point on, the rpm-proportional pressure is established in the suction chamber, and by this means an rpm-dependent shift on the injection onset toward "early" is adhered to.

Disadvantageously, the elevated suction chamber pressure and the resultant early injection onset results in rough, noisy engine operation.

OBJECT AND SUMMARY OF THE INVENTION

The fuel injection pump according to the invention has an advantage over the prior art that an elevated suction chamber pressure, controlled by the pressure maintenance valve, is operative only from the first run-up of the engine until the first time the pressure maintenance valve opens, even if the engine operating temperature has not yet been attained and the control device activated. Thus, the operating state in which rough engine operation and great engine noise arise is reduced to a minimum. Advantageously, the pressure maintenance function of the pressure maintenance valve is cancelled even the first time the engine runs up to speed, if the valve body is adjusted when the engine is warm as disclosed herein.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
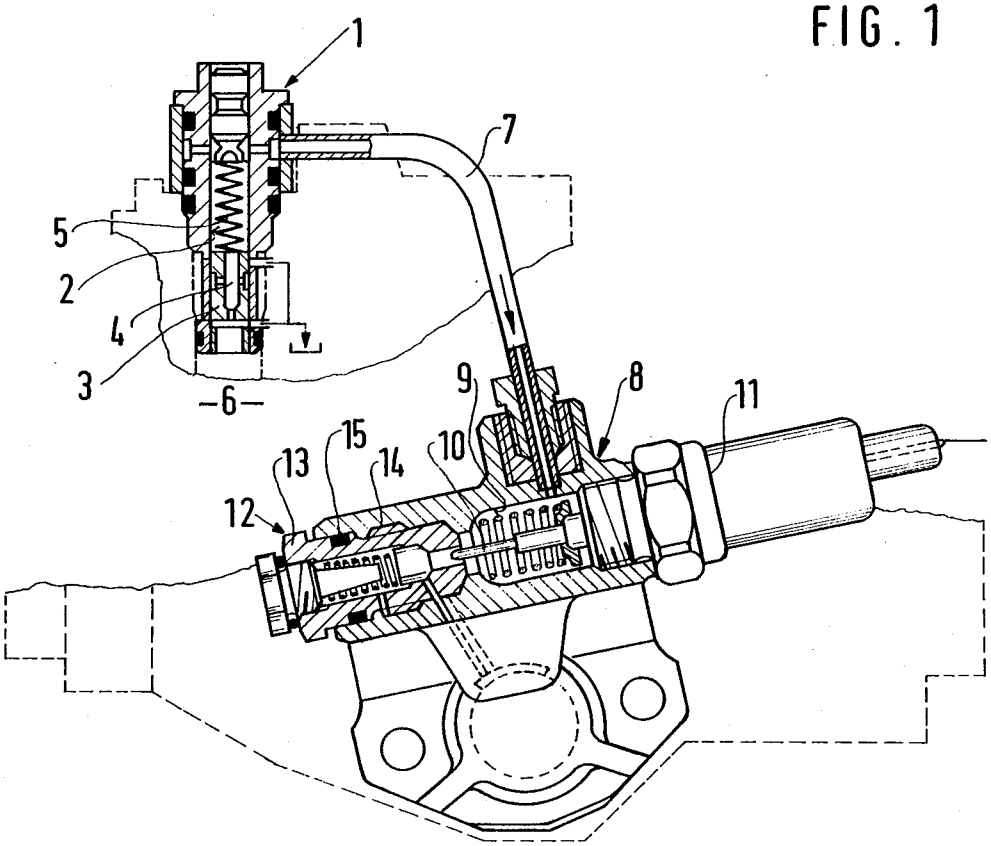
FIG. 1 shows an arrangement having a pressure maintenance valve.

FIG. 1 shows a fuel injection pump having a pressure control valve 1 and a pressure maintenance valve 8. A pre-supply pump, not shown, driven in synchronism with the fuel injection pump, pumps fuel from a fuel container into a suction chamber 6 of the fuel injection pump. From here, fuel flows at suction chamber pressure to one end of the pressure control valve and a control piston 3 therein, which is displaced counter to a restoring spring in accordance with the suction chamber pressure and thus with increasing suction chamber pressure shifts the instant of injection toward early.

The suction chamber pressure is controlled via the pressure control valve 1. The pressure control valve 1 has a control piston 3, which is acted upon at one end, in a pressure chamber, by the fuel pumped by the pre-supply pump and is engaged at the other end, in a restoring chamber 5, by a restoring spring. In its equilibrium position, the control piston 3 determines a diversion cross section, which is opened to a variable extent and from which there is communication with the suction chamber side of the pre-supply pump. A throttle connection 4 is provided in the control piston 3, connecting the pressure chamber and the restoring chamber 5 with one another. A pressure relief line 7 leads from the restoring chamber 5 into an inner chamber of a cylinder 9 of a pressure maintenance valve 8; this inner chamber is a continuation of the pressure relief line 7.

A control device that operates as a function of temperature is threaded into one face end of the cylinder 9. The control device, which functions as a disengagement device, comprises a temperature-dependent expansion adjuster 11 functioning as a control element. A control mandrel 10 protrudes coaxially out of the expansion adjuster 11 into the cylinder 9. The control mandrel 10 moves axially within the cylinder 9 whenever the cartridge, filled with an expansible material, of the expansion adjuster 11 is heated by a heating resistor connected to a battery voltage. Expansion adjusters 11 that are heated by the engine coolant also may be used.

Figure 2:
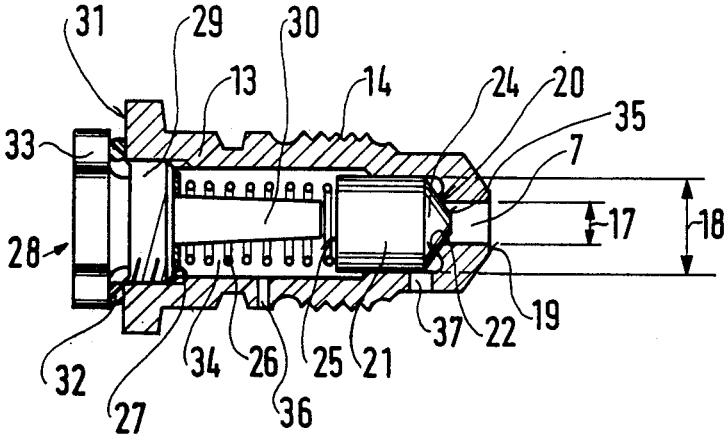
FIG. 2 is a section through the pressure maintenance valve, embodied in accordance with the invention, of the fuel injection pump.

On the other end of the cylinder 9, the pressure maintenance valve 8 has a valve insert 12, which has a valve cylinder 13 and is provided with a male thread 14, via which it ca be threaded into a corresponding female thread on the cylinder 9. The cylinder 13 is sealed off from the outside via a seal 15 and has a press fit, which seals off from the inner chamber of the cylinder 9. The pressure relief line 7 coming from the inner chamber of the cylinder 9 and through which the control mandrel 10 of the expansion adjuster 11 can be passed extends centrally through the face end of the valve cylinder 13 that is threaded into the cylinder 9. This pressure relief line 7 centrally disposed in the face end has a diameter 17, which as seen in FIG. 2 is less than the inside valve cylinder diameter 18, so that a circular annular surface remains at the face end 19 of the valve cylinder 13, at which surface, toward the inside of the valve cylinder 13, a valve seat 20 is disposed. A valve body 21 is loaded by a compression spring 26 supported in the valve cylinder 13 and, with a sealing face 22 provided on it, is retained on the valve seat 20 by the compression spring. The valve body 21 comprises a cylindrical piston, which merges with a valve cone 24 forming the sealing face 22. The valve cone 24 is embodied as a truncated cone and has a bearing face 35 on which the control mandrel 10 can rest. The sealing face 22 may, however, also be disposed on a hemispherical portion of the valve body 21. The piston of the valve body 21 slides with a tight and accurate fit in the valve cylinder 13. In the vicinity of the cylindrical wall of the valve cylinder 13 that in the closing position of the valve body 21 is located between the valve seat 2 and the cylindrical piston, a continuing pressure relief line 37 branches off.

While the engine is stopped, the sealing face 22 therefore rests on the valve seat 20, because the plane face 25 of the valve body 21 facing the valve cone 24 is subjected to the prestressed compression spring 26. The suction chamber pressure, which is created when the fuel injection pump comes into action, acts via the restoring chamber and the pressure relief line 7 upon the end face, defined by the diameter of the valve seat 20, of the valve body 21 and is propagated via the throttle connection 4 into the restoring chamber 5 and the cylinder 9; from there, it acts, counter to the closing force of the compression spring 26, upon the valve body end face determined by the diameter of the valve seat 20. Because the suction chamber pressure prevails on both ends of the control piston 3 of the pressure control valve 1, the control piston is displaced by the restoring spring far enough that the diversion cross section is closed. The suction chamber pressure increases continuously and steeply, until the opening pressure of the pressure maintenance valve 8 is attained. By then, it has attained a value that is far higher than the pressure that the pressure control valve would effect as a function of rpm with a fully relieved restoring chamber 5. Thus, an injection adjusting piston of an injection onset adjuster of known design is shifted by this high suction chamber pressure, counter to a restoring force, into a position that effects an early injection onset and promotes cold starting and cold engine operation. When the opening pressure is attained, the valve body 21 lifts from the valve seat 20 and opens up the pressure relief line 37 disposed in the wall of the valve cylinder 13.

At the same time, the end face of the valve body 21 resulting from the greater inside valve cylinder diameter 18 is acted upon by the suction chamber pressure. The cross section at the exit from the pressure relief line 7, that is, the cross section of the continuing pressure relief line 37 is opened up increasingly by the displacement of the cylindrical part of the valve body 21, until a pressure is established between the throttle connection 4 and the exit that keeps the valve body in the deflected position. This closing pressure, which is determined by the inside valve diameter and the restoring force of the compression spring 26, is less than the pressure established in the suction chamber by the pressure control valve 1 at the idling rpm of the engine. The specialized shift of the injection onset to early for cold starting is thus cancelled. As a result, now that the restoring chamber is relieved, the pressure control valve then establishes an rpm-dependent pressure.

Because the closing pressure is less than the pressure established in the suction chamber at idling rpm, the pressure maintenance valve cannot assume its closing position again until the engine stops, so that the shift toward early is not cancelled again until the engine is re-started. The pressure maintenance valve 8 thus has considerable control hysteresis; as a result, from a reopening of the pressure maintenance valve 8 until restopping of the engine, the pressure maintenance valve 8 remains open until the fuel injection pump stops, and the shift toward early for cold engine starting, that is, the cold starting acceleration, remains restricted to the first run-up of the engine. To prevent the maintenance valve 8 from closing again after the first run-up, the throttle connection in the control piston 3 and the cross section of the pressure relief line 37 leading out of the valve cylinder 13 must be related to one another. The compression spring 26 is supported at one end on a shoulder 27 of a threaded pin 28 that can be threaded into the valve insert 12. The threaded pin 28 comprises a hexagonal head adjoined by a portion with a male thread, which together with a stop bolt 30 conically formed onto this part forms the shoulder 27. The male thread can be threaded into a female thread 29 provided in the valve cylinder 13, so that the stop bolt 30 protrudes axially into the interior 34 of the valve cylinder 13. The screw insertion length of the stop body 30, which is sealed off by means of a sealing ring 32, is determined by the contact of the hexagonal head with the outer end face 31 of the valve cylinder 13, and the screw insertion length can be varied by disposing spacer shims between the hexagonal head and the end face 31. A leakage line 36 leads from the interior 34 to a return line, not shown.

As an alternative, the valve body could be connected to a diaphragm, instead of sliding tightly in the valve cylinder 13. In this versions, the diaphragm is tightly fastened in the valve cylinder and is provided centrally with a compression spring-loaded closing member, which controls the pressure relief line discharging into the face end of the valve cylinder 13. After it opens, the closing member, which may also be embodied as a disk or diaphragm plate, opens the pressure relief line 37, so that the pressure can be lowered.

With this fuel injection pump, it has been established that the engine runs roughly and has increased engine noise for only a brief time.

Once the engine, after some time in operation, has attained a predetermined temperature, the control mandrel 10 is extended, preventing the valve body 21 from pressing against the valve seat 20. The valve therefore does not come into play when the engine is warm.

Figure 3:
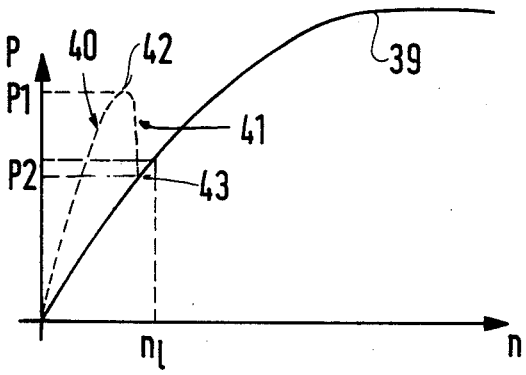
FIG. 3 shows characteristic pressure/rpm curves of the fuel injection pump according to the invention.

The function of the valve 12 is also represented in a diagram of suction chamber pressure (p) and engine rpm (n) in FIG. 3. At the beginning of fuel injection pump operation, the suction chamber pressure p increases rapidly and attains a value $p_1$, at which the valve body 21 lifts from the valve seat 20, remaining open until a suction chamber pressure $p_2$ that is less than $p_1$ is established. Thus, the pressure step is selected such that the closing pressure $p_2$ is below the suction chamber pressure at idling, so that the increase in the suction chamber pressure, which is important for the cold start acceleration, is effective only upon the first run-up of the engine. The solid line 39 represents the n/p function without cold start acceleration. The dashed curve 40 represents the n/p function with a cold engine and with cold start acceleration. The pressure step function can be seen from the pressure step curve 41, which extends from point 42 to point 43 on the diagram.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having an adjusting device for an injection onset and having a suction chamber that is connected to a pre-supply pump, a fuel supply pressure operative in the suction chamber is controllable as a function of rpm and actuates the injection onset adjusting device by means of a pressure control valve (1) secured to said suction chamber, the pressure control valve includes a control piston (3) which is acted upon by the suction chamber pressure counter to the restoring force of a spring (5) accommodated in a spring chamber, said control piston (3) is provided with a control edge for controlling an outflow of a portion of the supplied quantity of fuel from the suction chamber, said spring chamber communicates with the suction chamber via a throttle (4) and also said spring chamber can be relieved via a pressure relief line (7) in which a pressure maintenance valve (8) is connected, a temperature dependent control device is provided by means of which the pressure maintenance function of said pressure maintenance valve can be rendered ineffective and the spring chamber of the control device can be relieved independently of the pressure maintenance function of the pressure maintenance valve, the pressure maintenance valve comprises a valve cylinder (13) in which a valve body (21) is disposed, said valve body includes a sealing face (22) which is urged by a compression spring to come to rest on a valve seat (20) surrounding the pressure relief line 97) entering at one face end of the valve cylinder (13), said valve body controls fuel flow from the pressure relief line to an opening to a continuing pressure relief line (37), the valve body (21) is disposed in the valve cylinder (13) either directly or indirectly with a tight sliding fit, and said opening to said continuing pressure relief line (37) is disposed between the valve seat (20), and the valve body (21) in the wall of the valve cylinder (13), said pressure relief line includes an outlet which is at least partly open when the valve closing element is in a closed position, the closing pressure of the pressure maintenance valve (8) is less than the pressure in the suction chamber at idling rpm of the engine, which suction chamber pressure is controlled by the pressure control valve (1) and the opening pressure of the pressure maintenance valve is greater than the closing pressure of the valve.

2. A fuel injection pump as defined by claim 1, in which said valve body (21) is embodied as a cylindrical piston sliding tightly in the valve cylinder (13).

3. A fuel injection pump as defined by claim 1, in which said valve body is connected to a diaphragm serving as a movable wall.

4. A fuel injection pump as defined by claim 2, in which said cylindrical piston opens up said opening in said valve cylinder with increasing displacement of the piston counter to a compression spring (26) in a spring chamber (34).

5. A fuel injection pump as defined by claim 2, in which an axial travel of the cylindrical piston is limited by a stop bolt (30) of a threaded pin (28), said stop bolt being capable of being threaded into said valve cylinder (13).

6. A fuel injection pump as defined by claim 5, in which said compression spring (26) is disposed between a collar (27), attached to the threaded pin (28), and the valve piston (21).

7. A fuel injection pump as defined by claim 6, which includes a leakage line (36) that leads from the spring chamber (34) of the pressure maintenance valve (8) to a return line.

8. A fuel injection pump as defined by claim 1, in which said pressure maintenance valve (8) includes a disengagement device (11) as a said temperature-dependent control device.

9. A fuel injection pump as defined by claim 2, in which said pressure maintenance valve (8) includes a disengagement device (11) as a said temperature-dependent control device.

10. A fuel injection pump as defined by claim 3, in which said pressure maintenance valve (8) includes a disengagement device (11) as a said temperature-dependent control device.

11. A fuel injection pump as defined by claim 4, in which said pressure maintenance valve (8) includes a disengagement device (11) as a said temperature-dependent control device.

12. A fuel injection pump as defined by claim 5, in which said pressure maintenance valve (8) includes a disengagement device (11) as a said temperature-dependent control device.

13. A fuel injection pump as defined by claim 6, in which said pressure maintenance valve (8) includes a disengagement device (11) as a said temperature-dependent control device.

14. A fuel injection pump as defined by claim 7, in which said pressure maintenance valve (8) includes a disengagement device (11) as a said temperature-dependent control device.

15. A fuel injection pump as defined by claim 8, in which said disengagement device includes a control mandrel, which is guided through a portion of said pressure relief line (7) in an end face of the valve cylinder (13) and by which the valve body is adjustable.

16. A fuel injection pump as defined by claim 9, in which said disengagement device includes a control mandrel, which is guided through a portion of said pressure relief line (7) in an end face of the valve cylinder (13) and by which the valve body is adjustable.

17. A fuel injection pump as defined by claim 10, in which said disengagement device includes a control mandrel, which is guided through a portion of said pressure relief line (7) in an end face of the valve cylinder (13) and by which the valve body is adjustable.

18. A fuel injection pump as defined by claim 11, in which said disengagement device includes a control mandrel, which is guided through a portion of said pressure relief line (7) in an end face of the valve cylinder (13) and by which the valve body is adjustable.

19. A fuel injection pump as defined by claim 12, in which said disengagement device includes a control mandrel, which is guided through a portion of said pressure relief line (7) in an end face of the valve cylinder (13) and by which the valve body is adjustable.

20. A fuel injection pump as defined by claim 13, in which said disengagement device includes a control mandrel, which is guided through a portion of said pressure relief line (7) in an end face of the valve cylinder (13) and by which the valve body is adjustable.

21. A fuel injection pump as defined by claim 14, in which said disengagement device includes a control mandrel, which is guided through a portion of said pressure relief line (7) in an end face of the valve cylinder (13) and by which the valve body is adjustable.

* * * * *